US005794513A

United States Patent [19]

Kristensen

[11] Patent Number: 5,794,513

[45] Date of Patent: Aug. 18, 1998

[54] PRESSURE-APPLYING ARRANGEMENT IN A HYDRAULIC AXIAL PISTON MACHINE

[75] Inventor: Egon Kristensen, Nordborg, Denmark

[73] Assignee: Danfoss A/S, Nordborg, Denmark

[21] Appl. No.: 464,686

[22] PCT Filed: Jan. 7, 1994

[86] PCT No.: PCT/DK94/00012

§ 371 Date: Jun. 27, 1995

§ 102(e) Date: Jun. 27, 1995

[87] PCT Pub. No.: WO94/16221

PCT Pub. Date: Jul. 21, 1994

[30] Foreign Application Priority Data

Jan. 18, 1993 [DE] Germany ..... 43 01 120.9

[51] Int. Cl.[6] ..... F01B 13/04

[52] U.S. Cl. ..... 92/57; 92/71; 92/248; 417/269; 74/60

[58] Field of Search ..... 92/12.2, 57, 71, 92/248; 417/269; 91/499; 74/60

[56] References Cited

U.S. PATENT DOCUMENTS

| | | | |
|---|---|---|---|
| 3,187,644 | 6/1965 | Ricketts | 92/248 |
| 3,208,395 | 9/1965 | Budzich | 92/57 |
| 4,762,468 | 8/1988 | Ikeda et al. | 417/269 |
| 4,800,801 | 1/1989 | van Zweeden | 92/248 |
| 5,022,313 | 6/1991 | Shontz et al. | 92/248 |

FOREIGN PATENT DOCUMENTS

| | | | |
|---|---|---|---|
| 55-161981 | 12/1980 | Japan | 92/248 |
| 1342905 | 1/1974 | United Kingdom | 92/248 |

OTHER PUBLICATIONS

*Encyclopedia of Plastics* pp. 33–34 dated Dec. 1989.

*Primary Examiner*—Thomas E. Denion
*Attorney, Agent, or Firm*—Lee, Mann, Smith, McWilliams, Sweeney & Ohlson

[57] ABSTRACT

A pressure-applying arrangement in a hydraulic axial piston machine is disclosed, having a pressure plate (7) and a piston (9) that is axially displaceable in a cylinder body (3), is biased by a spring (10) and acts against the pressure plate (7). It should also be possible to use such a pressure-applying arrangement when the axial piston machine is operated with a hydraulic fluid that has no or only very little lubricating property, for example, water. For that purpose, the piston (9) is formed from a high-strength thermoplastics material.

9 Claims, 3 Drawing Sheets

PRESSURE-APPLYING ARRANGEMENT IN A HYDRAULIC AXIAL PISTON MACHINE

BACKGROUND OF THE INVENTION

Figure 1:
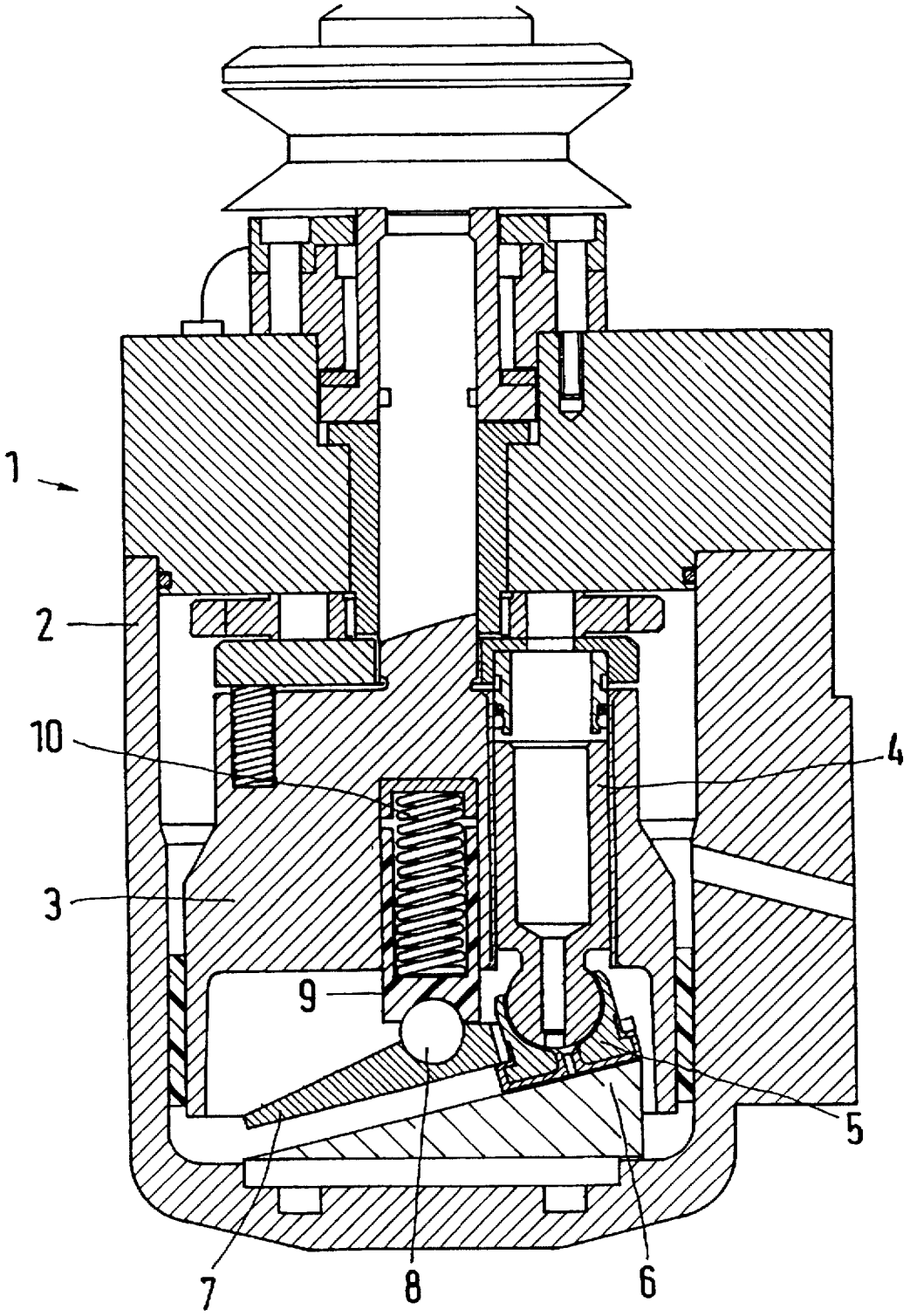

The invention relates to a pressure-applying arrangement in a hydraulic axial piston machine, having a pressure plate and a piston that is axially displaceable in a cylinder body, is biased by a force acting in an axial direction with respect to the cylinder body, and acts against the pressure plate.

By means of the pressure plate, slider shoes of work pistons are held in engagement with a slanting plate, which is inclined in known manner with respect to the axis of the cylinder body, so that on rotation of the cylinder body the work piston is moved back and forth. Whereas the slider shoes have no problem engaging the slanting plate during the inward movement of the piston into the cylinder body, during the outward movement of the work piston they have to be held by the pressure plate. The pressure plate therefore always has to remain parallel to the slanting plate, so that as the cylinder body rotates, the pressure plate performs a continuous tilting movement with respect to the cylinder body.

To allow this tilting movement, U.S. Pat. No. 2,733,666 provides a ball between the pressure plate and the piston. The piston is here biased by a spring. Opening into the contact surfaces between the ball and the piston and between the ball and the pressure plate there are channels through which hydraulic fluid is able to penetrate to the contact surfaces in order to reduce by lubrication the friction between the ball and piston and between the ball and the pressure plate. Without such lubrication, friction is relatively high so that this ball-and-socket joint would wear very quickly. In an extreme case, it could even seize up, leading to destruction of a part of the machine.

A hydraulic fluid that has a lubricating action is therefore an essential requirement here. This lubricating action is without exception a property of the hydraulic oils previously used as hydraulic fluids. Such oils are, however, in some cases toxic. From the point of view of their effect on the environment they are being used with increasing reluctance.

SUMMARY OF THE INVENTION

The problem on which the invention is based is to be able to use a pressure-applying arrangement even when hydraulic fluids having little lubricating action or even no lubricating action are to be used, for example, water.

This problem is solved in a pressure-applying device of the kind mentioned in the introduction in that the piston is formed from a high-strength thermoplastic plastics material.

When using such a plastics material, the ball and the pressure plate can continue to be made of metal, as they were previously. Since, however, metal is no longer rubbing on metal but on plastics material, lubrication can largely be eliminated. In most cases, lubrication is not required at all. For the rest, a film of fluid, such as that provided by water, for example, will be sufficient for lubrication.

The plastics material is preferably selected from the group of polyaryl ether ketones, especially polyether ether ketones, polyamides or polyamide imides. Such plastics materials are particularly low-friction in combination with metals, so that when they are used, further lubrication by means of oils or similar substances can be omitted without problems.

The plastics material is preferably reinforced by glass, graphite, polytetrafluoroethylene or carbon in fibre form. This measure enables the piston to be stressed by higher forces. Wear is reduced.

In a preferred construction, a ball is arranged between the piston and the pressure plate. This is admittedly already known per se from U.S. Pat. No. 2,733,666. In combination with the plastics piston, however its use is even better, and also requires no lubrication.

Advantageously the piston has a diameter which is at least 30% larger than the diameter of the ball. Because the plastics material, even when it is high-strength plastics material, does not normally attain the same mechanical strength as a part made of steel or another metal, this sizing ensures that the piston is nevertheless able to transfer to the pressure plate the forces required for pressing the slider shoes against the slanting plate. The sizing prevents the piston from expanding as a result of the counter-pressure exerted by the ball, leading to the piston jamming in the cylinder body.

In this connection it is preferable for the ball to be inserted in an end-face recess of the piston having a depth that corresponds to 0.3 to 0.4 times the diameter of the ball. The ball is therefore inserted relatively deeply in the piston. This enlarges the contact surface between the ball and the piston, but at the same time the surface loading is reduced, so that this measure enables improved coefficients of friction to be achieved. In combination with the larger diameter of the piston, reliable guidance of the ball and a high mechanical stability of the ball and piston arrangement is guaranteed.

In its furthest retracted position, the piston advantageously projects from the cylinder body by a length that is larger than the depth of the recess. Even when the piston undergoes slight deformation as a result of the pressure acting on the piston, the piston cannot jam in the cylinder body because the deformation is restricted to a region that always remains outside the cylinder body.

This is achieved with great reliability in particular when the length is at least 40% greater than the depth of the recess. The length is therefore at least 1.4 times the depth of the recess. Any deformations of the piston occurring in the region of the ball seat can continue for a short distance also in the axial direction, without the piston being able to jam in the cylinder body.

The force acting in the axial direction on the piston is preferably generated by a spring which is guided in an axial bore in the piston and bears against the base of the piston, the piston base having a thickness of at least 30% of the diameter of the ball. The piston base therefore has sufficient mechanical strength for jamming of the piston in the cylinder body to be prevented quite easily. The piston base should be at least as thick as the depth of the recess in which the ball is inserted.

In this connection is it especially preferable for the piston base to be thicker than the narrowest point of a circumferential wall radially surrounding the recess. Should deformation of the piston occur, this deformation is then effected in the region of the circumferential wall and not at the piston base, so that an opportunity is provided for deformations to become lost, as it were, which virtually excludes jamming of the piston in the cylinder body.

The pressure plate preferably has a recess receiving the ball, the contact surface between the ball and the pressure plate being larger than that between the ball and the piston. This ensures that the ball always moves only relative to the piston and not relative to the pressure plate. Although the friction between ball and pressure plate is greater in any case, because here metal rubs on metal, the correspondingly larger contact surface reinforces this effect even more. If the pressure plate moves relative to the cylinder body, the effect of this will always be that the ball slides only at the piston and does not rub on the pressure plate, so that wear and tear or destruction of the ball by the pressure plate or of the pressure plate by the ball can be excluded.

The pressure plate is preferably bevelled on its upper side facing the ball, and is thinner at its radial edge than in the middle, and this upper side, together with its opposite underside facing a slanting plate, forms an angle which is at least the same magnitude as the angle of inclination of the slanting plate. This ensures that the upper side of the pressure plate does not conflict with the piston, even when the piston projects relatively far in the direction of the pressure plate on account of the depth of its recess.

Advantageously, the pressure plate has at the lowest point of its recess substantially the same thickness as at the radial edge. This ensures that the pressure plate is able on the one hand to secure the ball with the required reliability. On the other hand, the entire pressure plate need not be dimensioned from the point of view of securing the ball. In addition, this construction enables a relatively uniform distribution of forces over the slider shoes.

It is also preferable for the piston, in particular in the region of its recess, to be in the form of a die-formed part. Since the metal ball is harder than the plastics material piston, larger tolerances than previously can be accepted. Any variations in the spherical shape are evened out in operation by the pressure of the metal ball in the plastics material piston. Since the demands on tolerances are no longer so strict, it is possible to simplify the manufacturing process and in particular to create the recess simply by die-forming.

In an especially preferred embodiment, on the upper side of the pressure plate there may even be formed a contact surface for the end face of the piston. This has the advantage that rotation of the piston in the cylinder body, occasionally taking the form of a drifting movement, can be avoided. The pressure plate rotates synchronously with the cylinder body. When the pressure plate is in contact with the piston always at one point, the piston is held fixedly, which is sufficient to keep the piston stationary in the cylinder body despite a possible disturbance by the tilting movement of the pressure plate. Should such a movement nevertheless occur, it is harmless, that is, causes no further wear and tear, since the engagement of the piston with the pressure plate has as little friction as it has with the ball. This embodiment is especially advantageous, however, because here the ball need not be used. The pressure plate "rolls" on the end face of the piston, wherein the contact surface can be described by a rotating radial ray. Since, however the piston and pressure plate are stationary with respect to one another in relation to the rotational movement, virtually no sliding friction occurs at the end face of the piston.

The angle is preferably substantially the same magnitude as the angle of inclination of the slanting plate. It is therefore not larger, but also not smaller, with the result that certain tolerances are allowed. In this manner the contact surface achieves its largest extent. Piston and pressure plate then lie adjacent to one another across the entire radius of the end face of the piston. This allows a relatively uniform compressive load per unit area. Wear and tear can therefore be avoided.

Advantageously, the contact surface extends right up to bores which are provided in the pressure plate for receiving slider shoes. The smallest distance between the contact surface and such a bore is here at most 25% of the radius of the piston. By this means, the contact surface can be selected to be as large as possible without the function or the mobility of the slider shoes being in any way impaired.

Figure 2:
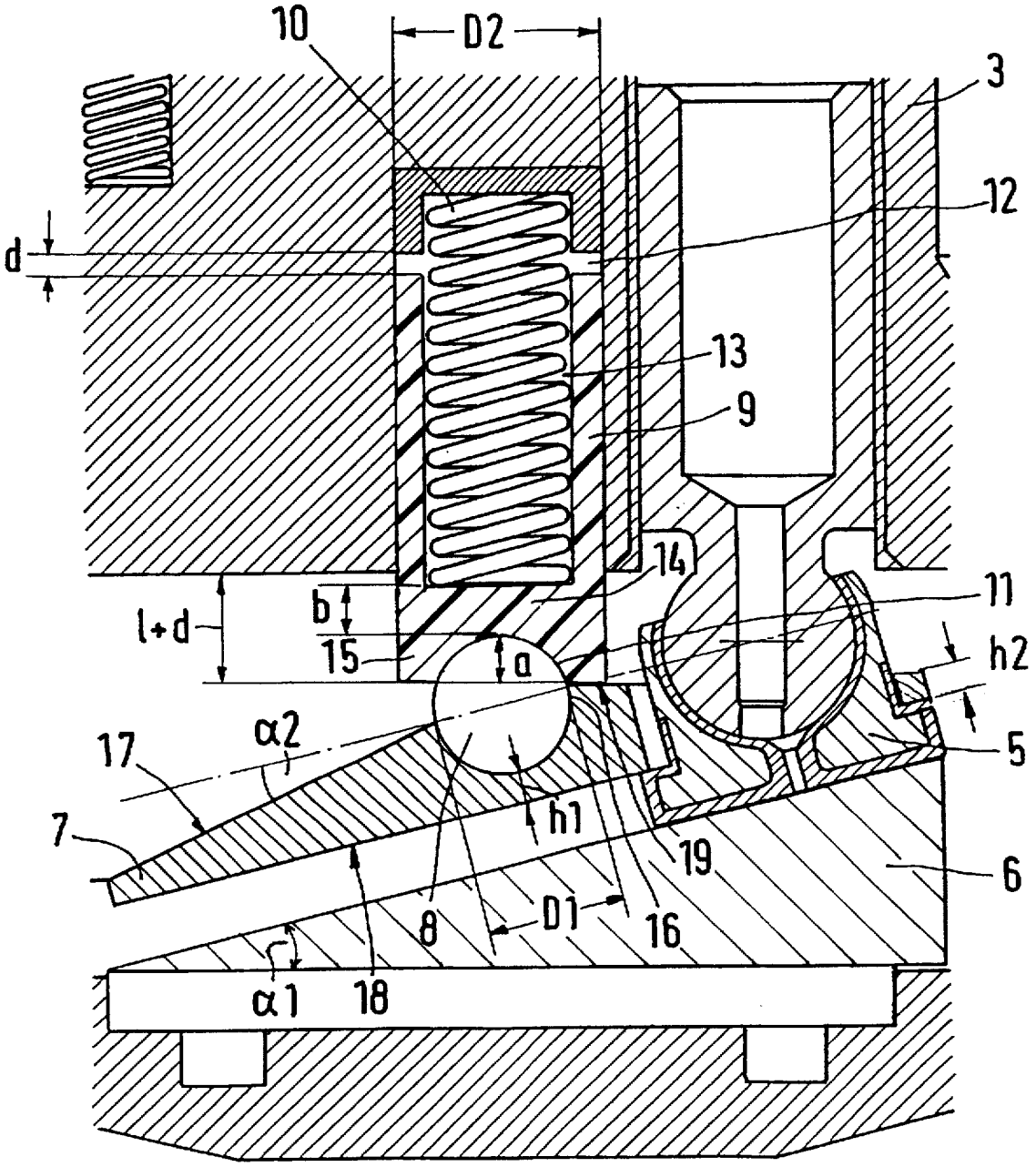
Figure 3:
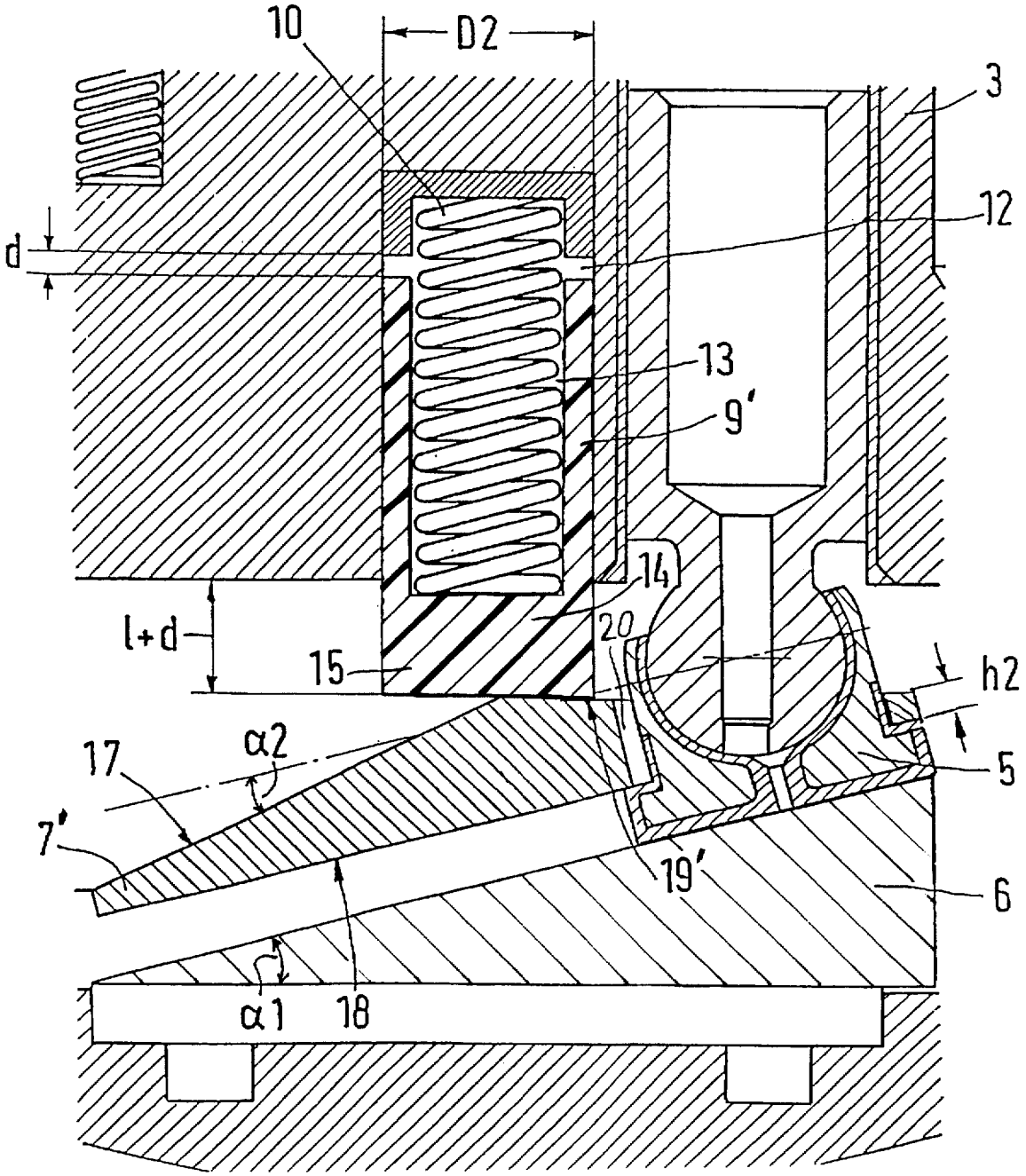

The invention is described hereinafter with reference to a preferred embodiment in conjunction with the drawing, in which FIG. 1 shows a diagrammatic cross-section through a hydraulic axial piston machine, FIG. 2 shows an enlarged fragmentary view from FIG. 1 and FIG. 3 shows an enlarged fragmentary view from a second embodiment.

A hydraulic axial piston machine 1 has a cylinder drum 3 rotatably mounted in a housing 2. Work pistons 4 are mounted in the cylinder drum 3 so as to move in an axial direction. Each work piston 4 is guided during this movement by a slider shoe 5 on a slanting plate 6. The slider shoe 5 is held in engagement with the slanting plate 6 by a pressure plate 7. Via the intermediary of a ball 8, the pressure plate 7 engages a piston 9 housed in the cylinder drum 3. The piston 9 is biased by a spring 10 acting in the axial direction, that is to say, it is pressed towards the slanting plate 6.

As is generally well known, on rotation of the cylinder drum 3 the work pistons 4 are moved back and forth in an axial direction. Since the pressure plate 7 must always remain parallel to the slanting plate 6, it performs a continuous tilting movement with respect to the cylinder drum 3. Here, the ball 8 represents an articulated joint between the pressure plate 7 and the cylinder drum 3. Relatively small axial movements of the cylinder drum 3 are compensated for by the spring 10, that is to say, even when the cylinder drum 3 undergoes relatively small axial movements the pressure plate 7 remains biased in such a way that the slider shoes 5 are always held in engagement with the slanting plate 6.

The machine 1 is intended to be operated with water as the hydraulic fluid. For that purpose the pressure-applying arrangement, which is constituted essentially by the pressure plate 7, the ball 8, the piston 9 and the spring 10, is designed so that it can also operate without lubrication by the hydraulic fluid. This is achieved in that the piston 9 is formed by a high-strength thermoplastic plastics material, which is selected from the group of polyaryl ether ketones, especially polyether ether ketones, polyamides or polyamide imides. The plastics material is reinforced by glass, graphite, polytetrafluoroethylene or carbon, this reinforcement being in the form of fibres. The ball 8 and the pressure plate 7 can still be made of metal. The ball 8 is accordingly in most cases harder than the piston 9. If a force is exerted by way of the piston 9 on the pressure plate 7, there is a danger that the piston will be deformed. Such a deformation will not be noticeable in most cases. If, however, the piston 9 is housed in the cylinder drum 3 with a relatively small tolerance, such a deformation could lead to jamming. Moreover, regardless of the choice of material, the piston 9 must, of course, be capable of transmitting the forces acting on the pressure plate 7.

For that purpose, the piston 9 first of all has a diameter D2 which is at least 30% larger than the diameter D1 of the ball 8. This enables the ball 8 to be accommodated in a end-face recess 11 of the piston 9 which has a relatively large depth a. This depth corresponds to 0.3 to 0.4 times the diameter D1 of the ball 8. A relatively large proportion of the ball 8 is therefore surrounded by the piston 9. The ball 8 is consequently guided in the piston 9, even laterally, in a very stable manner.

At its end opposite the ball 8, the piston 9 has a clearance space 12 of a length d in which to move, that is to say, it can be retracted further into the cylinder drum 3 by the distance d. When the piston 9 is retracted as far as it will go into the cylinder drum 3, it still projects by a length 1 with its ball end. In the position illustrated, in which the piston 9 is not retracted into the cylinder drum 3 as far as it will go, the length d of the clearance space 12 is added to this length 1. At all events, the length 1 is calculated so that it is greater than the depth a of the recess 11. It should be at least 40% greater than the depth a of the recess 11, so that deformations that may possibly occur because of force exerted by the ball 8 do not lead to the piston 9 jamming in the cylinder drum 3. The deformations are then restricted to a region that at any rate still projects from the cylinder drum 3.

The spring 10 is guided in the piston 9 in an axial bore 13 and bears on a piston base 14. The piston base has a thickness b which is at least as large as 30% of the diameter D1 of the ball 8. The thickness b of the piston base 14 is at any rate larger than the thinnest point of a circumferential wall 15 radially surrounding the recess 11. Deformations will then occur in the circumferential wall 15 rather than in the piston base 14. The thickness of the circumferential wall is determined by the difference in the diameters D1 and D2 of the ball 8 and the piston 9 divided by two.

The pressure plate has a recess 16 receiving the ball 8, in which the ball 8 is inserted to about half-way. The contact surface between the ball 8 and the pressure plate 7 is therefore larger than that between the ball 8 and the piston 9. The friction between the ball 8 and the pressure plate 7, which is in any case greater, on account of the metal-to-metal material combination, than between the ball 8 and the piston 9, is further increased by the larger contact surface, so that when the pressure plate 7 moves with respect to the piston 9 the ball 8 will rotate in the piston 9 but not, however, in the pressure plate 7.

The pressure plate 7 is bevelled on its upper side facing towards the piston 9; at its radial edge it is thinner than in its middle. With the opposing underside 18 the upper side 17 forms an angle $\alpha 2$ (the angle illustrated is the corresponding counter-angle of the same magnitude), which is at least the same magnitude as the angle of inclination $\alpha 1$ of the slanting plate 6. Although a relatively large proportion of the ball 8 is surrounded by the piston 9, conflict or interference between the pressure plate 7 and the piston 9 can consequently be reliably avoided. It is even possible to provide a contact surface 19 between the piston 9 and the pressure plate 7, although this is normally avoided by matching the depth of the recesses 11 and 16 suitably to the diameter of the ball 8.

The pressure plate 7 has a thickness h1 at the deepest point of its recess 16 which is essentially the same as the thickness h2 at its radial edge. This thickness determines the minimum stability of the pressure plate 7. By bevelling the upper side 17, however, the force introduced by way of the piston 9 and the ball 8 onto the pressure plate 7 is able to spread itself relatively uniformly from the inside to the outside, which results in flush engagement of the slider shoe 5 on the slanting plate 6.

An advantage of the pressure-applying arrangement is that only relatively modest demands are made on tolerance during manufacture because the harder ball 8 will in operation gradually even out relatively small variations in the recess 11 of the piston 9. Because of the low demands on tolerance, the piston 9 can be manufactured as a die-formed part. The recess 11 at least can be produced by die-forming, which is a relatively inexpensive manufacturing method, without the function of the pressure-applying arrangement being adversely affected.

FIG. 3 shows an enlarged fragmentary view from a second embodiment of a pressure-applying arrangement, which functions even without a ball between the piston 9' and the pressure plate 7'. Identical parts are provided with the same reference numbers and corresponding parts are provided with dashed reference numbers. If the ball is omitted, only the shape of the pressure plate 7' and the shape of the piston 9' alter. The contact surface 19' is enlarged correspondingly in a radially inward direction. The contact surface 19' can be described by a radial ray which starts at the centre point of the end face of the piston 9' and extends to the edge. The contact surface 19' will, of course, be given a certain width owing to the material characteristics. When the pressure plate 7' moves with respect to the slanting plate 6, the contact surface 19' rotates about the centre point of the end face of the piston 9'. There is therefore a kind of rolling movement between the pressure plate 7' and the piston 9', wherein sliding of the two parts against one another can be largely avoided. The frictional losses can here be kept very low specifically by the geometrical construction of the piston 9' and the pressure plate 7'. They are additionally reduced in that the piston 9' consists of the above-mentioned plastics material, in particular from the group of polyether ether ketones.

The contact surface 19' extends right up to bores 20 which are provided for receiving the slider shoes 5 in the pressure plate 7'. The contact surface between the piston 9' and the pressure plate 7', as far as it goes, is by that means enlarged and the compressive load per unit area is correspondingly reduced. The distance to the bores 20 is, on the other hand, still large enough for the function and the mobility of the slider shoes 5 in the pressure plate 7' not to be hindered. The additional length, that is to say, the distance between the piston 9' and the bores 20, should at its smallest point be about 10 to 20%, at any rate not more than 25%, of the radius of the end face of the piston 9'. In this way the pressure plate 7' also is relatively uniformly stressed. This has an advantageous effect on the tilting behaviour of the slider shoes 5.

I claim:

1. A pressure-applying arrangement in a hydraulic axial piston machine, the machine having a pressure plate and a piston, said piston being axially displaceable in a cylinder body, being biased by a force acting in an axial direction with respect to the cylinder body, and acting against the pressure plate, the piston being formed from a high-strength thermoplastic plastic material;

a ball is arranged between the piston and the pressure plate;

said piston has a diameter which is at least 30% larger than the diameter of the ball; and the ball is inserted in an end-face recess of the piston having a depth that corresponds to 0.3 to 0.4 times the diameter of the ball.

2. An arrangement according to claim 1, in which, in its furthest retracted position, the piston projects from the cylinder body by a length that is larger than the depth of the recess.

3. An arrangement according to claim 2, in which the length is at least 40% greater than the depth of the recess.

4. An arrangement according to claim 1, in which the force acting in the axial direction on the piston is generated by a spring which is guided in an axial bore in the piston and bears against a base of the piston, the piston base having a thickness of at least 30% of the diameter of the ball.

5. An arrangement according to claim 4, in which the piston base is thicker than a narrowest point of a circumferential wall of the base radially surrounding the recess.

6. An arrangement according to claim 1, in which the pressure plate has a recess receiving the ball, a contact surface in the pressure plate recess between the ball and the pressure plate being larger than a contact surface between the ball and the piston.

7. An arrangement according to claim 6, in which the pressure plate has a thickness at a deepest point of said recess which is essentially the same as a thickness at a radial edge of said recess.

8. A pressure-applying arrangement in a hydraulic axial piston machine, the machine having a pressure plate and a piston, said piston being axially displaceable in a cylinder body, being biased by a force acting in an axial direction with respect to the cylinder body, and acting against the pressure plate, the piston being formed from a high-strength thermoplastic plastic material in which the pressure plate is bevelled on an upper side facing the ball, and is thinner at its radial edge than in its middle, and said upper side, together with its opposite underside facing a slanting plate, forms an angle which is at least as large as an angle of inclination of the slanting plate.

9. A pressure-applying arrangement in a hydraulic axial piston machine, the machine having a pressure plate and a piston, said piston being axially displaceable in a cylinder body, being biased by a force acting in an axial direction with respect to the cylinder body, and acting against the pressure plate, the piston being formed from a high-strength thermoplastic plastic material, in which on an upper side of the pressure plate there is formed a rotating contact surface facing the piston, and in which the contact surface extends up to bores which are provided in the pressure plate for receiving slider shoes.

* * * * *